US005086854A

United States Patent [19]

Roussy

[11] Patent Number: 5,086,854

[45] Date of Patent: Feb. 11, 1992

[54] DRILL PIPES FOR ROTARY-VIBRATORY DRILLS

[76] Inventor: Raymond J. Roussy, 10241 - 148th Street, Surrey, B.C., Canada, V3R 6S4

[21] Appl. No.: 606,710

[22] Filed: Oct. 31, 1990

[51] Int. Cl.[5] ..... E21B 17/00; F16L 13/02

[52] U.S. Cl. ..... 175/320; 285/286; 285/330

[58] Field of Search ..... 175/320, 135, 415; 205/286, 330; 403/272; 138/109, 177

[56] References Cited

U.S. PATENT DOCUMENTS

| | | | |
|---|---|---|---|
| 1,260,690 | 3/1918 | Liady . | |
| 1,293,871 | 2/1919 | Murray | 285/286 |
| 1,515,355 | 11/1924 | Mitchell . | |
| 1,700,319 | 1/1929 | Kjekstad | 285/286 |
| 1,853,549 | 4/1932 | Clark . | |
| 1,993,269 | 3/1935 | Fletcher | 285/286 |
| 2,034,808 | 3/1936 | Graham | 285/286 |
| 2,132,575 | 10/1938 | Moise | 285/286 |
| 2,152,076 | 3/1939 | Menough | 285/286 |
| 2,711,912 | 6/1955 | Boice | 285/286 |
| 3,512,811 | 5/1970 | Bardgette et al. | 285/286 |
| 4,099,745 | 7/1978 | Cobbs | 285/24 |
| 4,735,444 | 4/1988 | Skipper | 285/286 |

*Primary Examiner*—Bruce M. Kisliuk
*Attorney, Agent, or Firm*—Norman M. Cameron

[57] ABSTRACT

A drill pipe for combination rotary-vibratory drills. The pipe includes an elongated pipe member and a connector for connecting the drill pipe to another drill pipe. The connector includes a threaded member at one end of the pipe member. The connector and pipe member have overlapping portions. The portion of one of the members has a plurality of circumferentially spaced-apart slots which are generally aligned axially with the pipe member, and welds along the slots securing the pipe member and connection member together.

3 Claims, 1 Drawing Sheet

DRILL PIPES FOR ROTARY-VIBRATORY DRILLS

BACKGROUND OF THE INVENTION

1. Field of the Invention

This invention relates to drill pipes for rotary-vibratory drills and, in particular, to joints for the drill pipes.

2. Description of Related Art

Rotary-vibratory drills employ a vibratory force superimposed upon a rotary action to accomplish the drilling operation. Sonic drills are rotary-vibratory drills where the vibration is in the sonic range.

Such sonic drills are used for such applications as drilling through overburden in placer exploration, installing concrete piles, water well drilling, rock drilling for blast holes and for rock coring.

One of the major reasons why sonic drilling machines have not been successful in the marketplace is the failure to develop suitable drill tooling. Extremely high alternating forces are generated within the drill pipe. Standard drill pipe is designed to withstand the torque developed during rotary drilling, but not the high alternating tensile and compressive loads encountered in sonic drilling.

These reversing loads are especially critical at the threaded ends of tool joints because of the stress concentration created by the presence of the threads.

Various approaches to solving the problem of joint failure have been attempted. One was to machine threads directly onto the drill pipe. This didn't work because the threads reduced the cross-sectional area of the pipe and simultaneously acted as a point of stress concentration as suggested above.

Another attempt was to use heavy wall pipe. However, it was then realized that the drill pipe stains or elongates and contracts the same amount in resonance regardless of its thickness. The greater cross section simply increases the force which must be transmitted by the joint, leading to failure at the 40 threads.

Next, drill pipe was tested with a relatively thick tool joint in relation to the thickness of the drill pipe. This configuration is routinely used for rotary drills used in drilling oil and water wells. These are generally assembled by circumferential welds between the pipe and threaded connection members used at the joint or by friction welding the members to the pipe. These welds however do not long withstand the fatigue loading conditions and high stress concentrations encountered in sonic drilling.

Pipe joints employing alternating fingers and slots extending circumferentially about the pipe have been used for other purposes such as the oil drilling platform disclosed in U.S. Pat. No. 3,521,811 to Bardgette. However, the problem encountered in that instance is not analogous to the difficulties encountered in sonic drilling and therefore does not suggest a solution to the problem.

SUMMARY OF THE INVENTION

The invention addresses the problems outlined above by providing a drill pipe for combination rotary-vibratory drills which comprises an elongated pipe member and means for connecting the drill pipe to another drill pipe. The means includes a threaded connection member at one end of the pipe member. The pipe member and connection member have telescopically overlapping portions. This portion of one of the members has a plurality of circumferentially spaced-apart slots which are generally axially aligned with the pipe member. Welds secure the pipe member and connection member together along the slots.

DESCRIPTION OF THE PREFERRED EMBODIMENTS

Figure 1:
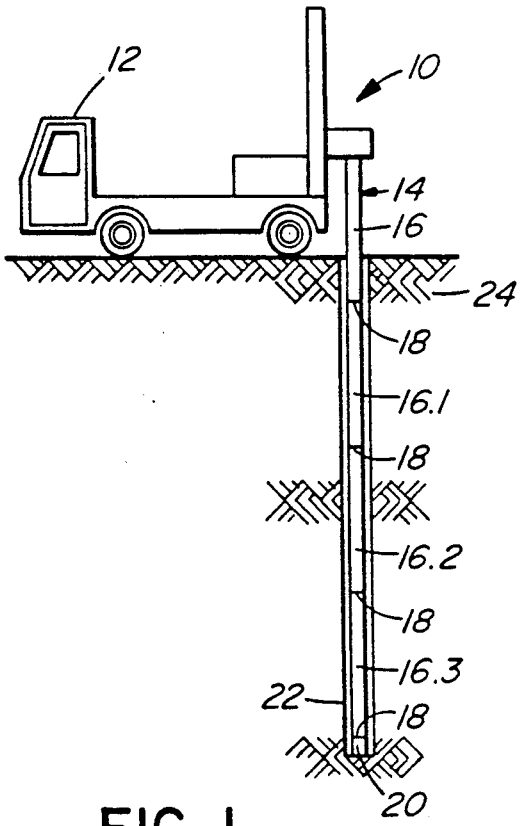
FIG. 1 is a diagrammatic elevation of a sonic drilling rig with the drill shown in position in a drill hole which is shown in section.

Referring to the drawings, FIG. 1 shows a sonic drilling rig 10 which, in this example, is mounted on the back of a truck 12. As mentioned above, sonic drills are combination rotary and vibratory drills where the vibrations are in the sonic range. The drilling rig is conventional and therefore is not described in greater detail.

The drilling rig is connected to a drill string 14 which includes a plurality of drill pipes 16, 16.1, 16.2 and 16.3 with a drilling tool 20 at the bottom end for drilling a drill hole 22 through overburden 24 or some other geological structure. The drill pipes are connected together by a series of pipe joints 18.

Figure 2:
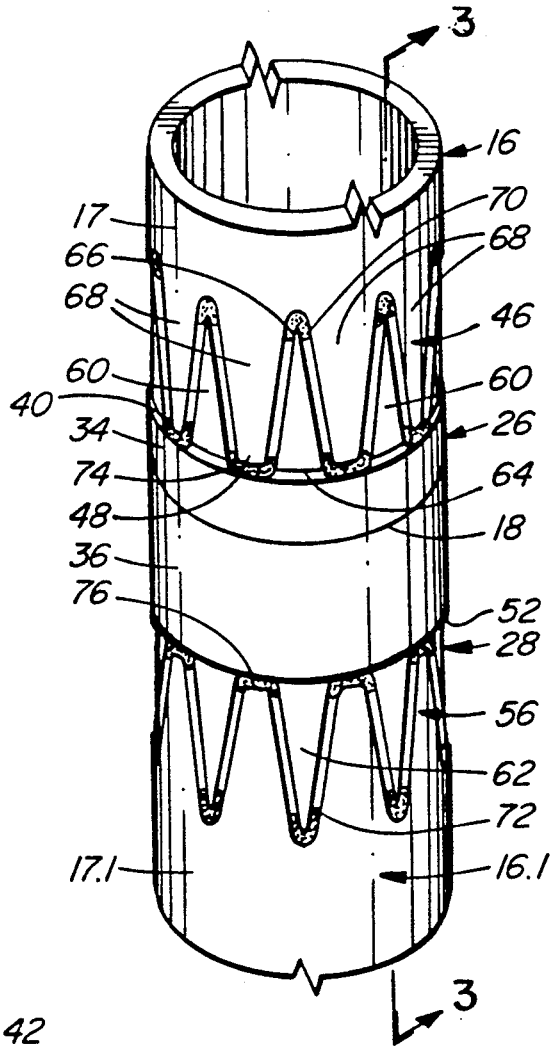
FIG. 2 is an enlarged, fragmentary isometric view of a section of the drill pipe from FIG. 1 showing one of the joints thereof.
Figure 3:
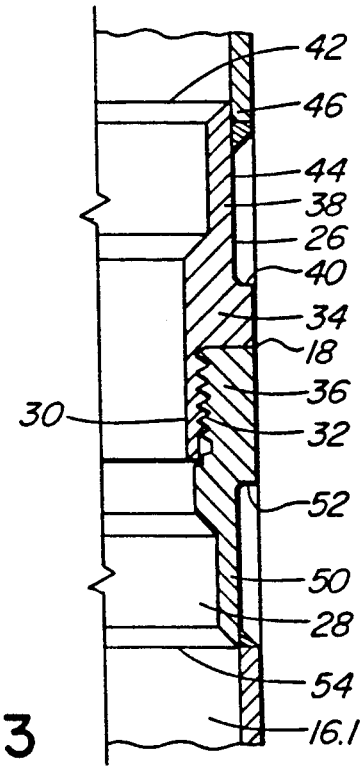
FIG. 3 is a sectional view taken along line 3—3 of FIG. 2.

One of the pipe joints 18 is shown in FIG. 2 and 3, the others being identical. The joint includes a male threaded connection member 26 which threadedly engages a complementary female threaded connection member 28. As shown best in FIG. 3, the threads 30 of member 26 engage the threads 32 of member 28.

The members 26 and 28 have outer portions 34 and 36 respectively which abut each other at joint 18, the threads 30 and 32 being machined onto the outer portions. Member 26 has an inner portion 38 which extends from shoulder 40 to inner end 42 of the member. Each of the pipes includes a pipe member, for example pipe members 17 and 17.1 of pipes 16 and 16.1 respectively. In this example the pipe members are of schedule 40, 4 inch pipe, though other available substitutes such as $4\frac{1}{2}'' \times 0.188''$ to $0.250''$ wall seamless tubing, ERW Oil Country Line Pipe or Oil Country Casing with a maximum wall thickness of $0.250''$ ($0.188''$ preferred), may be used. The invention also applies to pipe diameters other than 4 inch as used in this example.

The inner portion 38 of connection member 26 has an outside surface 44 with a diameter generally equal to the inside diameter of pipe member 17. End portion 46 of the pipe member overlaps the inner portion 38 of member 26 and has an end 48, shown in FIG. 2, which abuts the shoulder 40. In this example the pipe member 17 and outer portion 34 have equal outer diameters to a yield a uniform diameter on the outside of drill string 14.

Member 28 has an inner portion 50 which extends from shoulder 52 to inner end 54 of the member. It has similar configuration to portion 38 of member 26 and receives end portion 56 of pipe member 17.1.

In this example the members 26 and 28 are made from alloy steel tubing such as 4130 with a maximum content of:

Carbon 0.35%, manganese 1.4%, silicon 0.3%, sulfur 0.05% and phosphorus 0.04%.

The members are heat treated and stress relieved before final machining in this preferred example. The inner portions of the members are cooled in dry ice and acetone or the pipe ends are heated to 150° C. to fit the pipes over the inner portions of the connection members during assembly.

As seen best in FIG. 2, the end portions 46 and 56 of the pipe members have a plurality of slots 60 and 62 respectively. These are identical so only slots 60 are described in detail. Slots 60 have open ends 64 adjacent the outer portion 34 of connection member 26. The slots are elongated in the axial direction of pipe 16 and taper towards rounded inner ends 66 thereof, identified only for the center slot 60 as shown in FIG. 2. In this example there are nine slots circumferentially spaced-apart about pipe member 17 by a plurality of finger-like projections 68. The projections taper towards outer portion 34 of connection member 26.

As described above, the portion of pipe member 17 adjacent end 48 overlaps inner portion 38 of connection member 26. Welds 70, identified only for the center slot 60 in FIG. 2, secure the pipe member 17 to the connection member 26. The welds extend along the slots and are generally aligned with the axial direction of pipe 16 apart from the short connecting portions about inner ends 66 of the slots.

The end portions of the pipe members and the connection members are preferably pre-heated to a minimum 150° C. according to the conventional procedures for welding alloy steel. The welds 70 are a minimum ¼" in this preferred example and either E7018 low hydrogen rods or flux core wire is employed in welding. The welds are preferably flame stress relieved. Welds 72 are idential to welds 70 and therefore aren't described in detail.

In this embodiment there are also circumferential welds 74 between the end of pipe member 17 and outer portion 34 of connection member 26. These connect the welds 70 together. Similar circumferential welds 76 secure pipe member 17.1 to connection member 28.

The description above and the drawings are by way of example only. The invention includes modifications within the scope of the following claims.

By way of example, the pipe members could fit within the connection members. In that case the slots would be in the connection members.

What is claimed is:

1. In combination:

a rotary-vibratory drill and a drill string connected thereto, the drill string comprising a plurality of drill pipes and joints for connecting the drill pipes together, each of the joints including a female threaded connector, first means for connecting the female threaded connector to a first said drill pipe, a male threaded connector which threadedly engages the female threaded connector, and second means for connecting the male threaded connector to a second said drill pipe, each of the connectors having an outer portion and an inner portion, the outer portions and the pipes having equal outside diameters, the pipes having outer portions fitting over the inner portions of the connectors, the means for connecting each comprising circumferentially alternating slots and finger-like projections on the outer portions of the pipes which are elongated and aligned generally axially with the pipes and welds connected to the connectors and the pipes along edges of the slots.

2. A combination as claimed in claim 1, wherein the slots are open-ended adjacent the outer portions of the connectors and are tapered towards inner ends of the slots.

3. A combination as claimed in claim 2, wherein the inner ends of the slots are rounded.

* * * * *